US007789682B1

(12) United States Patent
Hitchcock et al.

(10) Patent No.: US 7,789,682 B1
(45) Date of Patent: Sep. 7, 2010

(54) ELECTRICAL CONNECTOR WITH LEVER AND CAMMING SLIDE

(75) Inventors: Matthew Bryan Hitchcock, Harrisburg, PA (US); Galen M Martin, Camp Hill, PA (US); Ryan Hetrick, Bressler, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 12/386,621

(22) Filed: Apr. 21, 2009

(51) Int. Cl.
*H01R 13/62* (2006.01)

(52) U.S. Cl. ..... 439/157; 439/347; 439/372

(58) Field of Classification Search ..... 439/157, 439/347, 372
See application file for complete search history.

(56) References Cited

U.S. PATENT DOCUMENTS 5,518,412 A * 5/1996 Larabell ..... 439/157
6,572,391 B2 * 6/2003 Mochizuki et al. ..... 439/157
6,854,992 B2 * 2/2005 Martin et al. ..... 439/157
6,899,554 B1 * 5/2005 Osada ..... 439/157
6,971,894 B2 * 12/2005 Dillon et al. ..... 439/157
6,997,725 B2 * 2/2006 Stella et al. ..... 439/157
7,070,438 B2 * 7/2006 Dillon ..... 439/347
7,568,925 B2 * 8/2009 Ciriello et al. ..... 439/157

* cited by examiner

*Primary Examiner*—Gary F. Paumen

(57) ABSTRACT

An electrical connector assembly is disclosed having a housing where at least one camming slide slides relative to the housing, and has a camming slot therein which is cooperable with a camming lug on a mating housing. The slide comprises an integral pin thereon. A connecting link is rotatable relative to the housing and includes an aperture which cooperates with the camming slide. A lever is rotatable relative to the housing and is profiled to rotate the connecting link, and in turn translate the slide. The housings are drawn together and apart upon movement of the slide.

17 Claims, 4 Drawing Sheets

ELECTRICAL CONNECTOR WITH LEVER AND CAMMING SLIDE

RELATED APPLICATION

The subject disclosure is related to Applicants file E-AV-00631 filed on even date as Ser. No. 12/386,600, the subject matter of which is incorporated herein by reference.

BACKGROUND

The subject disclosure relates generally to an electrical connector assembly having an actuation system to effect mating engagement of two connector halves.

Connector arrangements may have a plug housing, a socket housing, and an actuation means for moving one of the housings into engagement with the other housing such that receptacle contacts of the socket housing are electrically connected to pluggable contacts of the plug housing. These types of plug connector arrangements are primarily used in applications where one of the housings is fixed and accessibility to the plug connector arrangement is limited. These types of conditions typically exist, for example, in the automotive sector, for example in a door-to-body application.

In order to save space, the moveable housing is formed so that only a small portion of the moveable housing projects from the fixed housing when the housings are engaged. This configuration causes the disengagement of the moveable housing from the fixed housing to be difficult. A problem also exists in that the plug connector arrangement has a large number of contact elements that exert a high normal contact force such that considerable force is required to plug-in and release the moveable housing from the fixed housing.

In order to resolve these problems, plug connector arrangements have been provided with actuation systems including actuation camming slides. The actuation slides are arranged on the movable housing and is displaceable in a direction transverse to a direction of engagement. For example, the camming slides may be provided with camming slots that engage with cam projections on the fixed housing. Movement of the movable housing toward the fixed housing can be performed by displacement of the actuation slides transversely with respect to the direction of the movement of the moveable housing toward the fixed housing. In another example, an actuation slide means may be constructed as a toothed rack wherein the displacement of the moveable housing is forced by rotary movement of a pivotal lever with a pinion region engaging in the toothed rack. Examples of such actuation slides are taught by the following references, all of which are incorporated herein by reference: European Patent No. 0 273 999 B1 and U.S. Pat. Nos. 5,478,251; 5,593,309; 5,618,194 and 5,660,556. The actuation slide may be able to move through a lever as shown in U.S. Pat. No. 6,960,090, incorporated herein by reference.

In some configurations, given the number of contacts and the mating force to bring the two connectors together, these actuation slides are not effective for the mating engagement. Furthermore, the slides themselves, or the levers require significant open space around them for full travel, which may be an issue with packaging, installation or operation.

It is therefore desirable to develop a plug connector arrangement which can be pushed together and released in a simplified and secured manner while at the same time maintaining low manufacturing costs and saving space.

SUMMARY OF THE DISCLOSURE

The objects were accomplished by providing an electrical connector assembly comprising a housing, and at least one camming slide slidably movable relative to the housing. The at least one camming slide has a first actuation member thereon cooperable with a mating housing, such that the housings are drawn together and apart upon movement of the slide. The slide further comprises a second actuation member thereon. A connecting link is rotatable relative to the housing and includes a third actuation member which cooperates with the second actuation member upon rotation thereof to move the slide, and a fourth actuation member radially spaced from the third actuation member. A lever is rotatable relative to the housing and includes a fifth actuation member, which cooperates to rotate the connecting link, and translate the camming slide, upon rotation of the lever.

In another embodiment of the invention, an electrical connector assembly comprises a housing; at least one camming slide slidably movable relative to the housing, the at least one camming slide having a camming slot therein cooperable with a camming lug on a mating housing, such that the housings are drawn together and apart upon movement of the slide, a lever is rotatable relative to the housing, and a connecting link connects the lever to the camming slide.

In yet another embodiment of the invention, an electrical connector assembly, comprises a housing; at least one camming slide slidably movable relative to the housing and having an actuation member thereon cooperable with a mating housing, such that the housings are drawn together and apart upon movement of the slide; a lever is rotatable relative to the housing; and a linkage is positioned between the lever and the at least one camming slide, whereupon rotation of the lever cooperates to translate the camming slide.

DETAILED DESCRIPTION OF THE EMBODIMENTS

Figure 1:
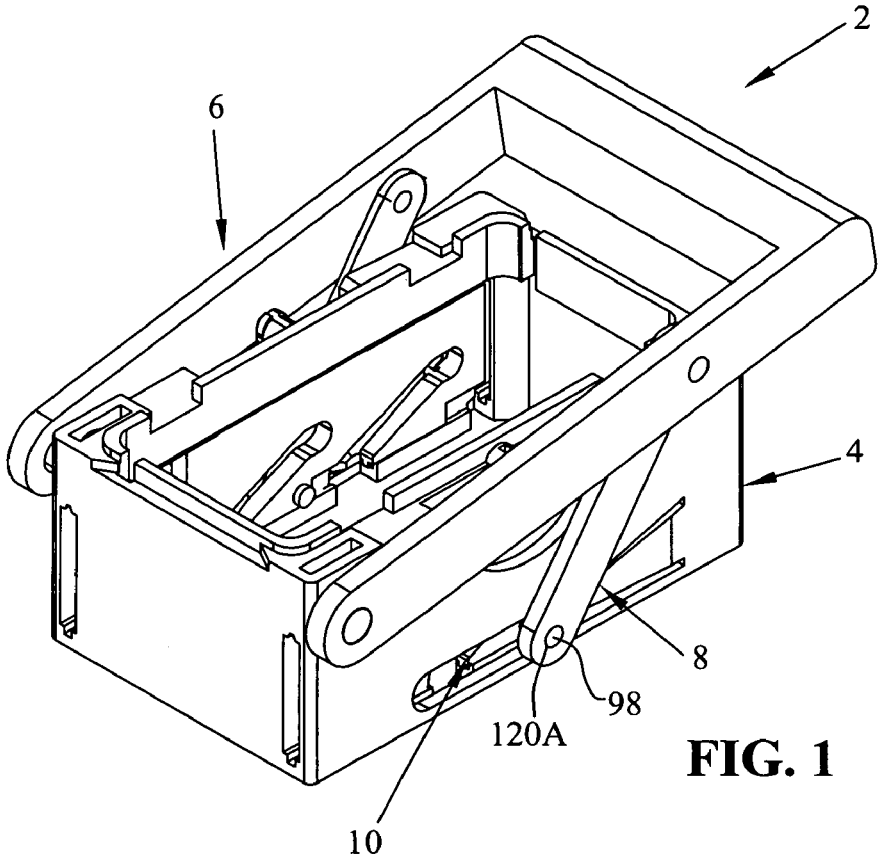
FIG. 1 is a top perspective view of the electrical connector assembly of the present invention.
Figure 2:
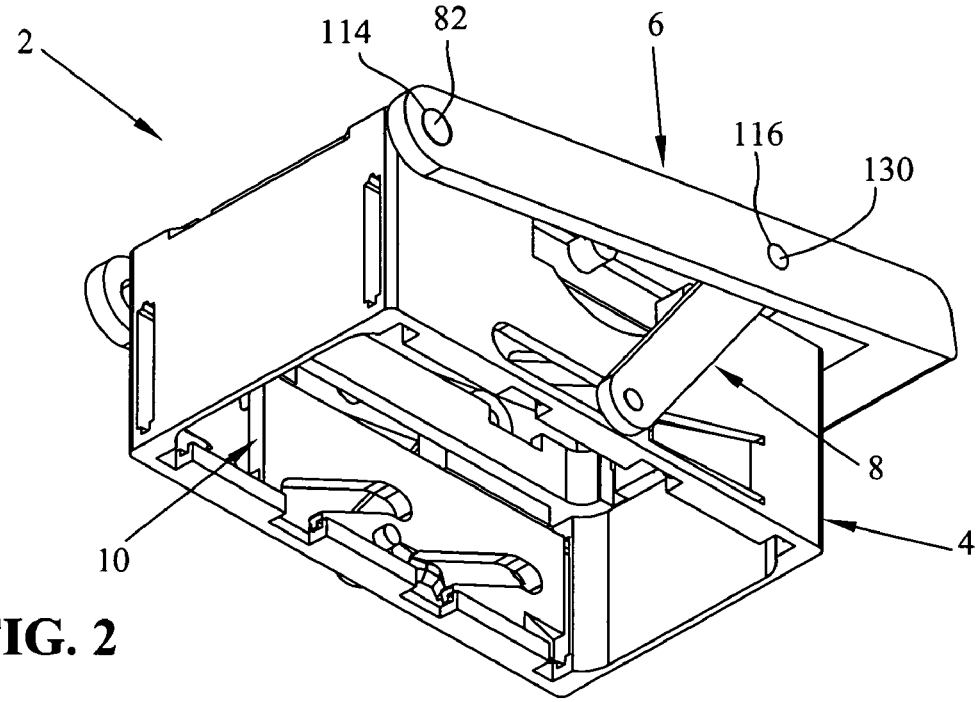
FIG. 2 is a bottom perspective view of the electrical connector assembly shown in FIG. 1.
Figure 3:
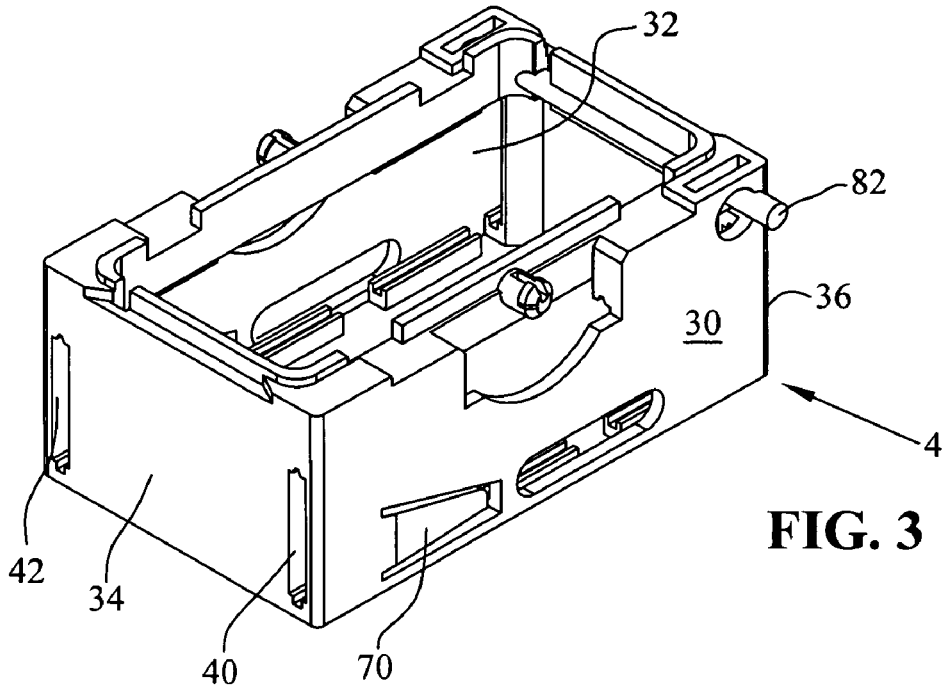
FIG. 3 is a top perspective view of the housing.

With reference first to FIGS. 1-2, an electrical connector assembly 2 is shown as comprised of a housing 4, a lever 6, a connecting link 8, and a camming slide 10. With reference now to FIG. 3, the housing 4 will be described in greater detail. Although while not shown, it should be appreciated that the electrical connector assembly 2 shown herein would include a front housing portion positioned within housing 4, and would include electrical contacts for electrical connection to a mating connector, as more fully disclosed herein.

Figure 4:
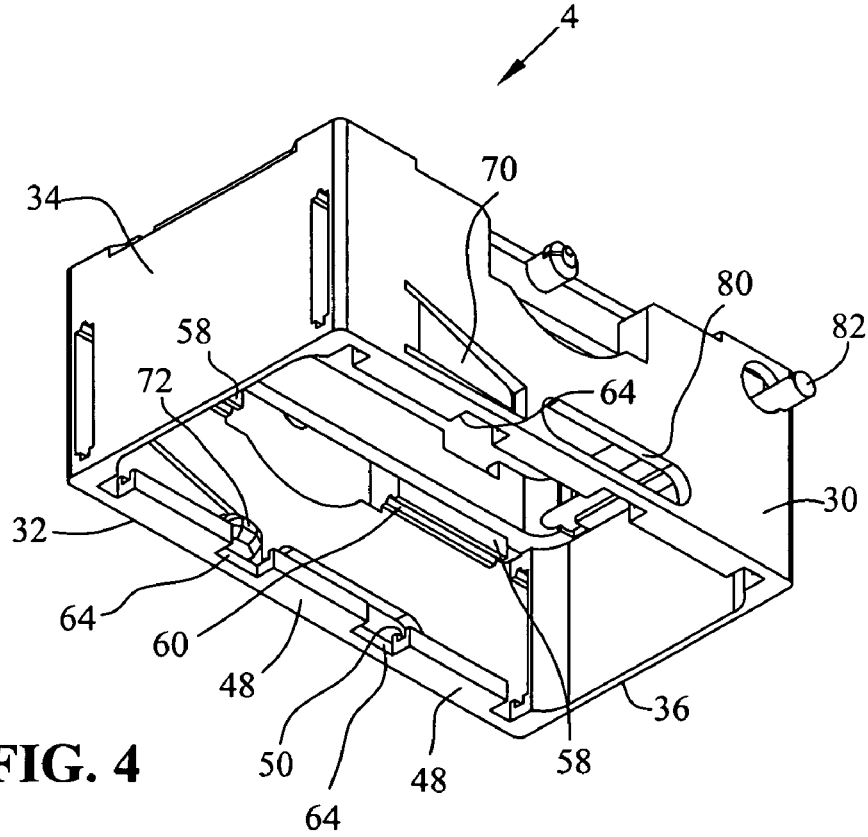
FIG. 4 is a bottom perspective view of the housing shown in FIG. 3.

With reference to FIGS. 3-4, housing 4 includes first and second sidewalls 30, 32 and end walls 34, 36. Slots 40 and 42 are defined through end walls 34 and 36, and are positioned against an inside of respective sidewalls 30 and 32. With reference to FIG. 4, the leading edge of the sidewalls 30 and 32 include lips 48 having a groove 50 formed therein. As also shown in FIG. 4, each of the sidewalls 30 and 32 also include upper bars 58 having grooves 60 formed therein. As should be appreciated, slots 40 and 42 is each profiled to receive one of the camming slides 10 as will be described further herein.

As shown, lips 48 are separated to define openings at 64. Each wall 30, 32 also includes a flexible latch 70 formed therein with a latching lug 72 aligned with one of the openings 64. As shown best in FIG. 4, each of the sidewalls 30, 32 also includes an elongate opening at 80. The elongate opening 80 communicates with slots 40 and 42 through each respective sidewall 30, 32. The sidewalls 30 and 32 also include an integral pin at 82 as described herein.

Figure 5:
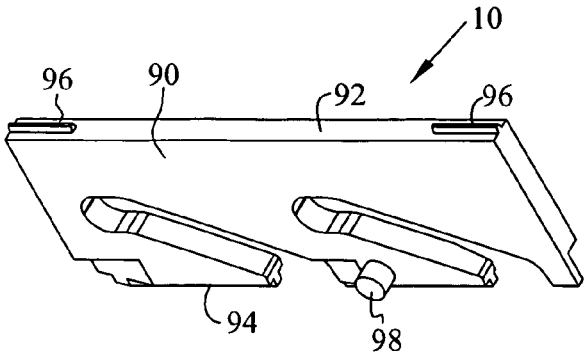
FIGS. 5 and 6 show top and bottom perspective views, respectively of the camming slide.
Figure 6:
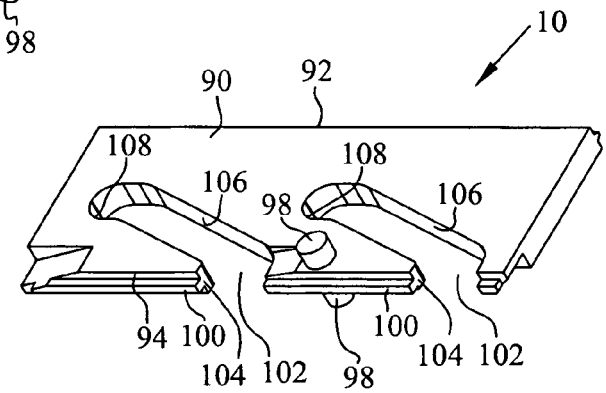

With respect now to FIGS. 5 and 6, camming slide 10 is shown in greater detail. Camming slide 10 is comprised of a rectangular body portion 90 having an upper edge 92 and a lower edge 94. Upper edge 92 includes a tongue 96 and an actuation member in the form of pins 98 which cooperate with connecting link 8 as described herein. As shown best in FIG. 6, lower edge 94 includes a tongue 100 which cooperates with tongue 96 for translation of the slide as described herein. Lower edge 94 also includes actuation members in the form of camming slots 102, where each camming slot includes an entry portion 104, an angled portion at 106 and a lateral end portion 108.

Figure 7:
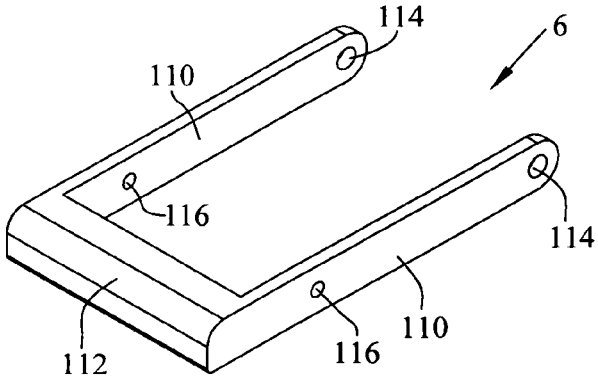
FIG. 7 shows a perspective view of the lever.

With reference now to FIG. 7, lever 6 includes lever arms 110 connected together by way of a lever handle 112. Each of the lever arms 110 includes an aperture 114, profiled to be positioned over pin 82. An actuation member in the form of aperture 116 is profiled to be connected to connecting link 8 as described herein.

Figure 8:
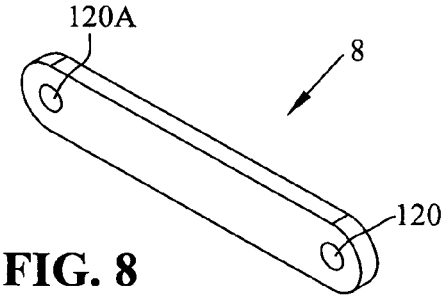
FIG. 8 shows a perspective view of the connecting link.

As shown in FIG. 8, connecting link 8 is an elongate member having apertures 120A and 120B at opposite ends thereof, as described herein. With the above described elements, the assembly and operation of the connector assembly 2 will be described herein.

It should be appreciated that the camming slides 10 are received in respective slots 40 and 42 such that the camming slots 102 (FIG. 5) open downwardly and the respective tongues 96, 100 (FIGS. 5 and 6) may be received in corresponding grooves 50, 60 (FIGS. 3 and 4). This places the camming slides 6 on the inside of sidewalls 30, 32. This also aligns the pin 98 (FIG. 6) within the elongate opening 80 (FIG. 4). Camming slides 6 may translate between the extreme positions of pins 98 within elongate openings 80.

Connecting links 8 are now positioned over the housing sidewalls 30, 32 such that one of the apertures 120A defines a further actuation member and are positioned over pins 98. It should be appreciated that camming slide 10 has two pins 98, one on each side. This allows identical camming slides 10 to be used (but in a mirror image relationship to each other) and placed in the two slots 40, 42 with one pin 98 positioned in one of the elongate openings 80, and on the opposite side, the opposite pin is positioned in the other elongate opening 80.

Lever 6 may now be assembled to housing 4 such that apertures 114 (FIG. 7) are positioned over pins 82 (FIG. 3), and apertures 116 (FIG. 7), and apertures 120B are aligned to each other. A fastener, such as a pin 130 (FIG. 2) retains the two apertures 82, 102B in rotational registry with each other. Thus as should be appreciated, rotation of lever 6 causes a rotation of connecting link 8, which in turn causes a translation of the camming slides 10, as described below.

Figure 9:
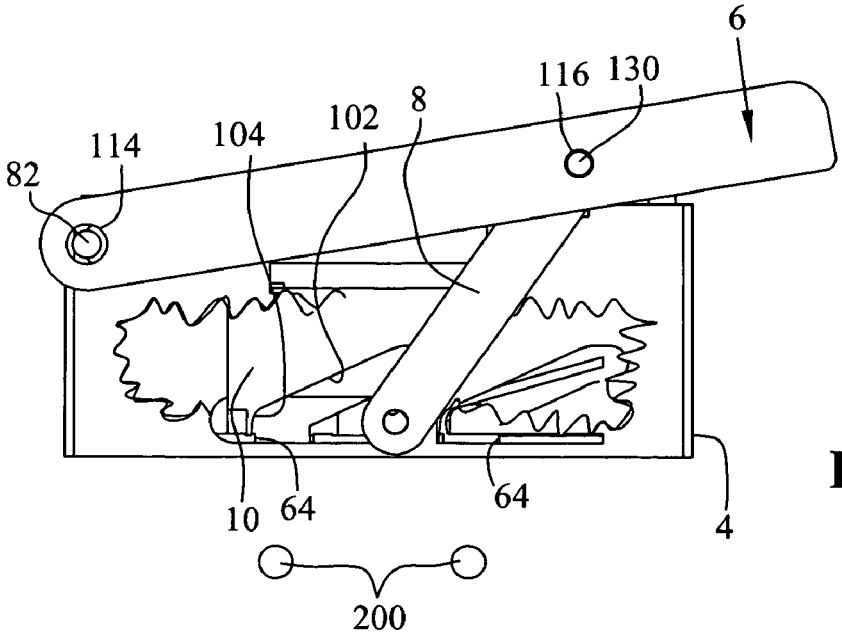
FIGS. 9-11 show side plan views of the connector assembly in partial fragmentation in various operating positions.

With respect now to FIG. 9, it should be appreciated that connecting links 8, camming slides 10 and lever 6 are dimensioned and assembled such that the fully open position of lever 6 (FIG. 9 position) coincides with the alignment of camming slots 102 (and in particular with entry portions 104) and openings 64 of housing portion 4. The lugs incorporated on a mating connector are shown diagrammatically in FIG. 9 as 200. The mating connector is placed within housing 10 with lugs 200 positioned through openings 64 and into the entry portions 104 of camming slots 102.

Figure 10:
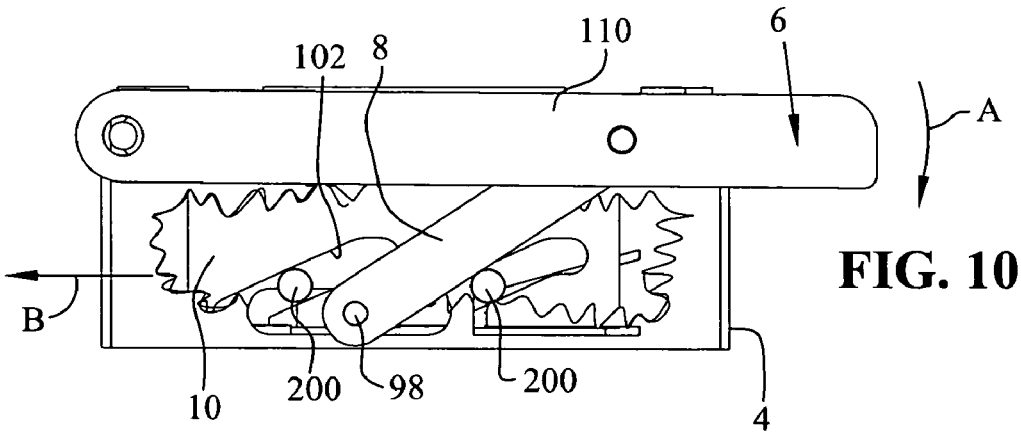
Figure 11:
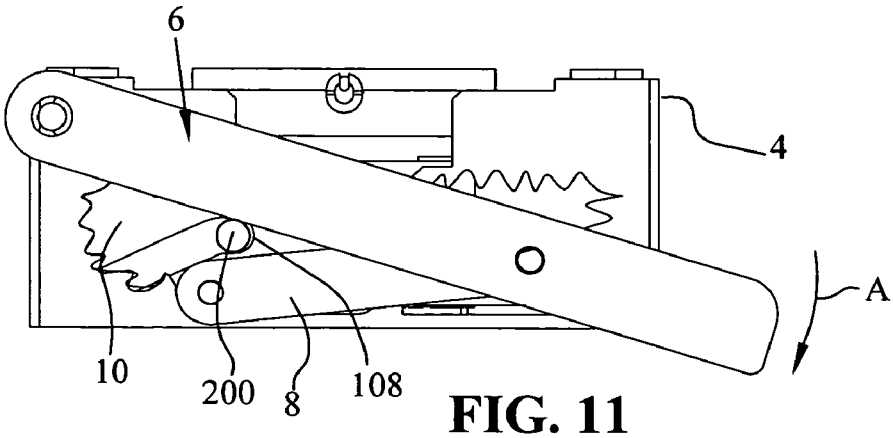

At this position, lever 6 may be rotated in the clockwise direction of arrow A, as viewed in FIG. 10. This rotation causes lever arms 110 to rotate thereby causing a rotation of connecting links 8. The rotation of connecting links 8, in turn causes a translation of the camming slides 10 to the left in the direction of arrow B as viewed in FIG. 10. This causes the lugs 200 of the mating connector to be cammed upwardly into camming slots 102, as also shown in FIG. 10. It should be appreciated to one of ordinary skill in the art that the movement of the lugs 200 into the camming slots 102 causes a drawing together of connector assembly 2 with the mating connector which contains the lugs 200. Continued rotation of the lever 6 (in the direction of arrow A) to the position of FIG. 11 causes a full rotation of the connecting link 8 and a full translation of camming slides 10 to the left, moving the two connector housings into a fully mated position with lugs 200 positioned within the lateral end portions 108 of the camming slots 102.

It should also be appreciated that the latches 70 (FIG. 4) on main housing portion 12 position latching lugs 72 at opposed openings 64 as best shown in FIGS. 2 and 4. Thus when the lugs 200 of mating connector are positioned into the configuration of FIG. 9, the latching lugs 72 would engage with the lugs 200 to momentarily retain the two connectors in position, at least until such time as lever 6 is actuated. Thus, the lugs 200 of mating connector could be inserted into the connector assembly 2 with one hand, and lever 6 could be actuated without requiring two hands to make the final connection.

What is claimed is:

1. An electrical connector assembly, comprising:

a housing;

at least one camming slide slidably movable relative to the housing, the at least one camming slide having a first actuation member thereon cooperable with a mating housing, such that the housings are drawn together and apart upon movement of the slide, the slide further comprising a second actuation member thereon;

a connecting link being rotatable relative to the housing and including a third actuation member which cooperates with the second actuation member upon rotation thereof to move the slide, and a fourth actuation member radially spaced from the third actuation member;

a lever being rotatable relative to the housing and to the connecting link and including a fifth actuation member, which cooperates with the fourth actuation member to rotate the connecting link, and translate the slide, upon rotation of the lever.

2. The electrical connector of claim 1, wherein the first actuation member is comprised of a camming slot.

3. The electrical connector of claim 1, wherein the second actuation member is comprised of a pin.

4. The electrical connector of claim 1, wherein the third actuation member is comprised of an aperture on the connecting link.

5. The electrical connector of claim 1, wherein the fourth actuation member is comprised of an aperture which cooperates with the lever.

6. The electrical connector of claim 5, wherein the fifth actuation member is comprised of an aperture on the lever.

7. An electrical connector assembly, comprising:

a housing;

at least one camming slide slidably movable relative to the housing, the at least one camming slide having a camming slot therein cooperable with a camming lug on a mating connector, such that the housing and the mating connector are drawn together and apart upon movement of the slide;

a lever being rotatable relative to a fixed axis on the housing; and a connecting link which connects the lever to the camming slide.

8. The electrical connector of claim 7, wherein the housing comprises sidewalls and endwalls, and at least one slot extending through the end wall to receive the at least one camming slide.

9. The electrical connector of claim 8, wherein the camming slide is comprised of a pin.

10. The electrical connector of claim 9, wherein the housing sidewalls include elongate opening which access the pins on the camming slides.

11. The electrical connector of claim 10, wherein the lever is comprised of an aperture cooperable with the camming slide pins.

12. The electrical connector of claim 8, comprising two camming slides with two slots extending through the endwalls to receive the camming slides.

13. The electrical connector of claim 12, wherein the slots extend along an inside face of the sidewalls.

14. The electrical connector of claim 12, wherein the camming slots on the camming slides comprise entry portions adjacent to a mating face of the housing to receive the camming lugs on the mating connector.

15. The electrical connector of claim 12, wherein the housing includes latches positioned adjacent to the entry portions, and are profiled to latch with the camming lugs on the mating connector.

16. An electrical connector assembly, comprising:

a housing having a mating face and a rear face;

at least one slide slidably movable relative to the housing, the at least one slide having an actuation member thereon cooperable with a mating housing, such that the housings are drawn together and apart upon movement of the slide;

a lever having at least one lever arm and a lever handle, the lever arm being rotatable relative to the housing, with the lever handle not passing over the rear face; and a linkage between the lever and the at least one slide, whereupon rotation of the lever, the linkage cooperates to translate the slide.

17. The electrical connector of claim 16, wherein the link is comprised of a mechanical connecting link positioned between the lever and camming slide.

* * * * *